United States Patent [19]

Swiatosz

[11] 4,349,723

[45] Sep. 14, 1982

[54] ELECTRICALLY HEATED NON-TOXIC SMOKE GENERATOR

[75] Inventor: Edmund Swiatosz, Maitland, Fla.

[73] Assignee: The United States of America as represented by the Secretary of the Navy, Washington, D.C.

[21] Appl. No.: 137,227

[22] Filed: Apr. 4, 1980

[51] Int. Cl.[3] ..... H05B 1/00; F22B 27/00; B01F 13/00

[52] U.S. Cl. ..... 219/271; 43/129; 122/40; 122/41; 219/273; 219/275; 219/325; 219/365; 239/136; 252/302; 252/359 R; 252/359 CG

[58] Field of Search ..... 219/271–276, 219/325, 326, 365, 378; 239/135–138; 122/40, 41; 252/302, 359 R, 359 CG; 43/128, 129, 130, 127

[56] References Cited

U.S. PATENT DOCUMENTS

| | | | |
|---|---|---|---|
| 219,311 | 9/1879 | Salisbury | 122/40 X |
| 377,228 | 1/1888 | Bartlett | 122/40 |
| 734,871 | 7/1903 | Hopwood et al. | 122/40 |
| 736,652 | 8/1903 | Taboulevitsch | 122/40 |
| 1,322,374 | 11/1919 | Trumble | 122/40 |
| 1,475,589 | 11/1923 | Marden | 122/41 X |
| 1,627,668 | 5/1927 | Robbins | 122/40 |
| 2,451,019 | 10/1948 | Davis | 252/359 |
| 2,569,809 | 10/1951 | Flynn | 219/378 X |
| 2,850,615 | 9/1958 | Luse, Jr. et al. | 219/271 X |
| 3,003,279 | 10/1961 | Bonanno | 46/9 |
| 3,242,098 | 3/1966 | Andrews | 252/359 |
| 3,410,986 | 11/1968 | Groom | 219/271 |

*Primary Examiner*—A. Bartis

*Attorney, Agent, or Firm*—Robert F. Beers; Robert W. Adams; David S. Kalmbaugh

[57] ABSTRACT

A non-toxic smoke generator for simulating the smoke of a fire includes an inner cylindrical shell surrounded in spaced relation by a thermally insulated outer casing to form an air flow passage therebetween through which compressed air heated by electric air heaters is caused to flow in a helical pattern to heat the shell to a temperature above the vaporization temperature of a vaporizable smoke substance. The smoke substance, such as propylene glycol, polyethylene glycol 200 or mineral oil, is pumped from a reservoir through a supply pipe having a coiled preheating portion disposed in the space between the shell and housing and is sprayed through a wide spray atomizing nozzle into heated vaporization chamber where it is vaporized and discharged as non-toxic smoke.

13 Claims, 1 Drawing Figure

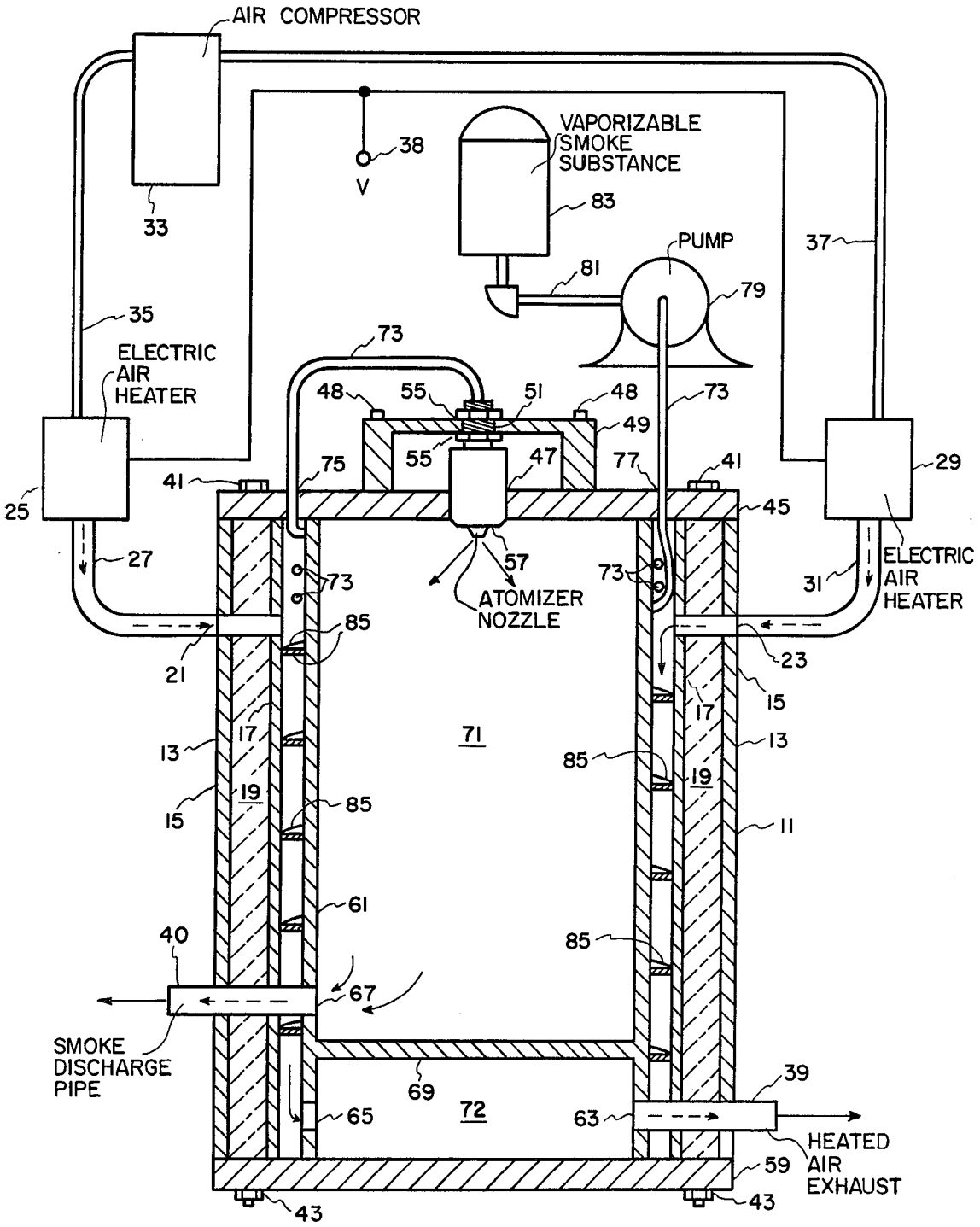
AIR COMPRESSOR
33
38
V
VAPORIZABLE SMOKE SUBSTANCE
83
PUMP
81
79
37
35
ELECTRIC AIR HEATER
25
27
29
ELECTRIC AIR HEATER
31
73
48
55
51
48
49
73
55
47
77
41
41
75
45
57
ATOMIZER NOZZLE
73
73
85
21
23
15
17
13
71
85
13
19
15
85
19
11
61
40
85
67
SMOKE DISCHARGE PIPE
69
39
65
72
63
HEATED AIR EXHAUST
59
43
43

ELECTRICALLY HEATED NON-TOXIC SMOKE GENERATOR

BACKGROUND OF THE INVENTION

1. Field of the Invention

This invention relates generally to training devices. In particular, this invention relates to a training device for simulating the smoke of a fire.

2. History of the Prior Art

A wide variety of training devices are available for generating nontoxic smoke so as to teach a student, under realistic conditions, how to handle a fire. One such device of the prior art simulates smoke by utilizing steam admixed with an organic liquid so as to produce a vaporized organic liquid, and forcing the vaporized organic liquid through a narrow orifice into air so that the vapor is rapidly chilled. While performing satisfactorily for its intended purpose of generating smoke, this device of the prior art ordinarily leaves something to be desired, especially from the standpoints of energy utilization efficiency, design complexity, and cost effectiveness.

In addition, there are commercially available a variety of foggers which generate smoke. Heat transfer to vaporize the smoke producing material is generally provided by propane heaters, gasoline engines, or electric heater coils. While working quite well for their intended purpose of producing smoke, these devices of the prior art ordinarily leave something to be desired from the standpoints of smoke producing capacity and energy utilization efficiency.

SUMMARY OF THE INVENTION

The subject invention overcomes some of the disadvantages of the prior art, including those mentioned above, in that it comprises a relatively simple nontoxic smoke generator which produces a nontoxic smoke.

Included in the subject invention is a cylindrical housing having a first end plate at the lower end thereof and a second end plate at the upper end thereof, a vaporization chamber mounted within the cylindrical housing, and a nozzle positioned in the center of the second end plate. Mounted within the cylindrical housing around the periphery of the vaporization chamber is a preheating coil which has one end thereof connected to the nozzle. Positioned below the preheating coil within the cylindrical housing around the periphery of the vaporization chamber is a heat transfer fin.

Compressed air, which is heated by a pair of electric air heaters, is fed to a pair of air inlet ports located on the cylindrical housing, circulates around the periphery of the vaporization chamber in a helical pattern so as to provide heat thereto, and is discharged into the atmosphere through an air exhaust pipe in the cylindrical housing.

Propylene glycol supplied from a storage tank is fed through the preheating coil to the nozzle. The nozzle then sprays the propylene glycol against the inner surface of the varporization chamber so as to vaporize the propylene glycol, thereby forming smoke which is discharged into the atmosphere through a smoke discharge pipe located on the vaporization chamber.

BRIEF DESCRIPTION OF THE DRAWING

The FIGURE is a cross-sectional view of the nontoxic smoke generator constituting the subject invention.

DESCRIPTION OF THE PREFERRED EMBODIMENT

The preferred embodiment of the subject invention will now be discussed in some detail in conjunction with the FIGURE of the drawing, wherein like parts are designated by like reference numerals.

Referring now to the FIGURE, there is shown a non-toxic smoke generator 11 which comprises a cylindrical housing 13 having an outer wall 15 and an inner wall 17. Located between outer wall 15 and inner wall 17 of cylindrical housing 13 is a layer of insulative material 19 which may be, for example, ceramic fiber.

Positioned near the upper end of cylindrical housing 13 and passing therethrough are a pair of air inlet ports 21 and 23, the first of which is connected to the outlet port of an electric air heater 25 by a pipe 27, and the second of which is connected to the outlet port of an electric air heater 29 by a pipe 31. The inlet ports of electric air heater 25 and 29 are respectively connected to the first and second outlet ports of a compressor unit 33 by pipes 35 and 37. Connected to the electrical input of electric air heaters 25 and 29 is a voltage source 38.

Electric air heaters 25 and 29 are conventional heater elements and are commercially available from several different sources. In particular, it has been found that a heater element Model 2Z075A, manufactured by Dayton Electric of Chicago, Illinois, performs satisfactorily as electric air heaters 25 and 29.

Positioned near the lower end of cylindrical housing 13 and passing therethrough is an air exhaust pipe 39. Positioned above air exhaust pipe 39 on the opposite side of cylindrical housing 13 and passing therethrough is a smoke discharge pipe 40.

Mounted upon the upper end of cylindrical housing 13 and secured thereto as by a plurality of bolts 41 and nuts 43 is an end plate 45 having an aperture 47 located in the center thereof. Mounted upon end plate 45 and secured thereto by a plurality of bolts 48 is a support bracket 49. Support bracket 49 has in the center thereof an aperture 51 which is in alignment with aperture 47 of end plate 45.

Mounted through aperture 51 of support bracket 49 and secured thereto by a pair of nuts 55 and extending through aperture 47 of end plate 45 is a nozzle 57. Nozzle 57 may be any well known, conventional, and commercially available wide spray atomizing nozzle. In particular, it has been found that a wide spray atomizing nozzle Model 1/4 NN3W, manufactured by Spraying Systems, Inc., of Wheaton, Illinois, performs quite satisfactorily as nozzle 57.

Mounted upon the lower end of cylindrical housing 13 and secured thereto by the aforesaid plurality of bolts 41 and nuts 43 is a lower end plate 59. Mounted within inner wall 17 of cylindrical housing 13 between end plates 45 and 59 is a cylindrical shell 61 which has passing therethrough a pair of aligned apertures 63 and 65, and a third aperture 67 positioned above aligned apertures 63 and 65. Fixedly connected to aperture 63 of cylindrical shell 61 is air exhaust pipe 39 and fixedly connected to aperture 67 of cylindrical shell 61 is smoke discharge pipe 40.

Located within cylindrical shell 61 between apertures 63 and 65 and aperture 67 is a wall 69, which with end plate 45 and cylindrical shell 61 forms a vaporization chamber 71. A cavity 72 is formed within cylindrical shell 61 between wall 69 and end plate 59. Wall 69, of course, may be attached to the inner surface of cylindrical shell 61 by suitable means, such as welds.

Connected to nozzle 57 is one end of a preheating coil 73. Preheating coil 73 then passes through an aperture 75 of end plate 45, winds around the periphery of cylindrical shell 61, passes through an aperture 77 of end plate 45, and is connected to the discharge port of a pump 79. It may be noteworthy to mention that preheating coil 73 may be fabricated from stainless steel pipe.

Connected to the intake port of pump 79 by a supply line 81 is a storage tank 83 which has stored therein propylene glycol, a smoke producing substance.

Mounted between inner wall 17 of cylindrical housing 13 and the outer surface of cylindrical shell 61 and attached thereto by conventional means such as a plurality of spot welds is a heat transfer fin 85. Although not shown in such detail, heat transfer fin 85 begins at one end of nontoxic smoke generator 11 slightly below air inlet ports 21 and 23, winds around the periphery of cylindrical shell 61, and terminates at the opposite end of nontoxic smoke generator 11 slightly above aperture 65 of cylindrical shell 61. In addition, it may be noted at this time that heat transfer fin 85 may be fabricated from a thin strip of a steel alloy such as, for example, stainless steel.

The operation of the subject invention will now be discussed in conjunction with the FIGURE of the drawing.

Referring to the FIGURE, compressed air is supplied from compressor unit 33 to the inlet port of electric air heater 25 through pipe 35 and the inlet port of electric air heater 29 through pipe 37. The compressed air is then heated to a temperature of approximately 600° F. by electric air heaters 25 and 29 which are energized by voltage source 38.

The heated air is fed from the outlet port of electric air heater 25 through pipe 27 to air inlet port 21 and the outlet port of electric air heater 29 through pipe 31 to air inlet port 23 at a pressure of 0.036 pounds per square inch. The heated air then circulates around the periphery of cylindrical shell 61 in a helical pattern at a velocity of approximately forty-eight feet per second, passes through aperture 65 into cavity 72, and is discharged from nontoxic smoke generator 11 through air exhaust pipe 39. As will be discussed more fully below, circulation of the heated air in a helical pattern around the periphery of cylindrical shell 61, at a high velocity, provides for a maximum heat transfer rate to vaporization chamber 71.

Propylene glycol is supplied by storage tank 83 to the intake port of pump 79 which feeds the propylene glycol to nozzle 57 through preheating coil 73 so as to preheat the propylene glycol to a temperature of approximately 120° F. This preheating of the propylene glycol lowers the viscosity thereof so as to allow nozzle 57 to spray the propylene glycol in a hollow cone spray pattern against the inner surface of cylindrical shell 61. Heat then transfers through cylindrical shell 61 to the propylene glycol within vaporization chamber 71, thereby causing the propylene glycol to vaporize so as to form a nontoxic smoke which is discharged from non-toxic smoke generator 11 through smoke discharge pipe 40.

As mentioned above, circulation of heated air at a high velocity around the periphery of cylindrical shell 61 provides for the maximum heat transfer rate to vaporization chamber 71. Thus, for example, for an apparatus similar to the one illustrated in the FIGURE, the heat transfer rate was found to be approximately 4300 BTU's per hour for a flow rate of one gallon per hour of propylene glycol to vaporization chamber 71. In addition, it may be noteworthy to mention that utilization of a wide spray atomizing nozzle as nozzle 57 allows for the maximum coverage of the inner wall of cylindrical shell 61 with propylene glycol so as to facilitate the efficient operation of the subject invention.

While propylene glycol is the preferred smoke producing agent to be utilized by nontoxic smoke generator 11, it is contemplated that other liquids such as polyethylene glycol 200 and mineral oil may be employed as the smoke producing agent for the subject invention.

From the foregoing, it may readily be seen that the subject invention comprises a new, unique, and exceedingly useful nontoxic smoke generator which constitutes a considerable improvement over the known prior art. Obviously, many modifications and variations of the present invention are possible in light of the above teachings. It is, therefore, to be understood that within the scope of the appended claims the invention may be practiced otherwise than as specifically described.

What is claimed is:

1. An apparatus for producing nontoxic smoke comprising in combination:

an open-ended cylindrical housing vertically orientated so as to have an upper end and a lower end;

said cylindrical housing having a pair of air inlet ports located near the upper end thereof, an air exhaust pipe located near the lower end thereof, and a smoke discharge pipe located near the lower end thereof;

means defining a vaporization chamber mounted within and spaced from said cylindrical housing, said vaporization chamber having an inner surface, an open top and closed bottom, and an aperture in alignment with the smoke discharge pipe of said cylindrical housing and connected thereto;

a first end plate secured to the lower end of said cylindrical housing so as to close the lower end of said cylindrical housing;

a second end plate secured to the upper end of said cylindrical housing so as to close the open top of said vaporization chamber, and close the upper end of said cylindrical housing, said second end plate having a first aperture located in the center thereof, and second and third apertures located near the periphery thereof;

nozzle means mounted within the first aperture of said second end plate for spraying a liquid in a hollow cone spray pattern against the inner surface of said vaporization chamber so as to vaporize said liquid and thereby produce nontoxic smoke;

coil means having one end thereof connected to said nozzle means and passing through the second aperture of said second end plate, the opposite end thereof connected to a source of vaporizable smoke producing substance and passing through the third aperture of said second end plate, and the remainder thereof wound around the outer periphery of said vaporization chamber for preheating said liquid so as to reduce the viscosity thereof and thereby allow for the spraying of said liquid in said hollow cone spray pattern by said nozzle means;

helical fin means wound around the outer periphery of said vaporization chamber below said coil means and said air inlet ports so as to bridge the space between said vaporization chamber and said cylindrical housing;

said helical fin means being positioned between the air inlet ports and the air exhaust pipe of said cylindrical housing and forming a helical airflow path therebetween;

electric air heater means having a first outlet port connected to the first inlet port of said cylindrical housing and a second outlet port connected to the second inlet port of said cylindrical housing for supplying heated air under pressure through the first and second inlet ports of said cylindrical housing to said helical airflow path between said cylindrical housing and said vaporization chamber;

said air heater means being adapted for supplying the heated air at a temperature sufficient to heat said vaporization chamber to a temperature above the vaporization temperature of the liquid being vaporized;

said helical fin means being adapted for circulating the heated air supplied thereto by said air heater means around the periphery of said vaporization chamber so as to provide for a maximum heat transfer rate to said vaporization chamber, and then passing the heated air to the air exhaust pipe of said cylindrical housing so as to allow for the discharge of the heated air from said nontoxic smoke producing apparatus by the air exhaust pipe of said cylindrical housing.

2. The apparatus according to claim 1, wherein said nozzle means comprises a wide spray atomizing nozzle.

3. The apparatus according to claim 1, further characterized by a support bracket attached to said second end plate, said support bracket having an aperture passing therethrough in alignment with the first aperture of said second end plate, the aperture of said support bracket having said nozzle means mounted therein so as to support said nozzle means.

4. The apparatus according to claim 1, further characterized as having propylene glycol stored within said source of vaporizable smoke producing liquid.

5. The apparatus according to claim 1, further characterized as having polyethylene glycol 200 stored within said source of vaporizable smoke producing liquid.

6. The apparatus according to claim 1, wherein said electric air heater means comprises:

a first air heater having an inlet port and an outlet port connected to the first inlet port of said cylindrical housing;

a second air heater having an inlet port and an outlet port connected to the second inlet port of said cylindrical housing; and an air compressor having first and second outlet ports, the first of which is connected to the inlet port of said first air heater and the second of which is connected to the inlet port of said second air heater.

7. A nontoxic smoke generator comprising in combination:

an open-ended cylindrical housing vertically orientated so as to have upper and lower ends;

said cylindrical housing having an outer wall, an inner wall, a pair of air inlet ports located near the upper end thereof, an air exhaust pipe located near the lower end thereof, and a smoke discharge pipe located near the lower end thereof;

an open-ended cylindrical shell vertically disposed within said cylindrical housing and spaced from the inner wall of said cylindrical housing, said cylindrical shell having an outer surface, an inner surface, a wall intermediate the upper and lower ends thereof, a first aperture positioned below said intermediate wall, a second aperture positioned below said intermediate wall in alignment with the air exhaust pipe of said cylindrical housing and connected thereto, and a third aperture positioned above said intermediate wall in alignment with the smoke discharge pipe of said cylindrical housing and connected thereto;

a first end plate secured to the lower end of said cylindrical housing so as to close the lower end of said cylindrical housing and said cylindrical shell to thereby form a cavity between said first end plate and the intermediate wall of said cylindrical shell;

a second end plate secured to the upper end of said cylindrical housing so as to close the upper end of said cylindrical housing and said cylindrical shell to form a vaporization chamber within said cylindrical shell between said second end plate and the intermediate wall of said cylindrical shell, said second end plate having first and second apertures located therein and positioned above the space between the inner wall of said cylindrical housing and the outer surface of said cylindrical shell, and a third aperture centrally located therein;

a nozzle mounted within the third aperture of said second end plate for spraying a smoke producing liquid in a hollow cone spray pattern against the inner surface of said vaporization chamber so as to vaporize said smoke producing liquid and thereby produce nontoxic smoke;

a preheating coil mounted within said cylindrical housing between the inner wall thereof and the outer surface of said cylindrical shell, said preheating coil having one end thereof connected to said nozzle and passing through the first aperture of said second end plate, and the opposite end thereof connected to a source of vaporizable smoke producing substance and passing through the second aperture of said second end plate;

a heat transfer helical fin mounted within said cylindrical housing between the inner wall thereof and the outer surface of said cylindrical shell below said preheating coil and said inlet ports and forming a helical air flow path between said air inlet ports and said first aperture;

electric air heater means having a first outlet port connected to the first air inlet port of said cylindrical housing, and a second outlet port connected to the second air inlet port of said cylindrical housing, adapted for supplying heated air under pressure through said first and second inlet ports of said cylindrical housing to the space between said cylindrical housing and said cylindrical shell, and through said first aperture to the cavity formed between said first end plate and the intermediate wall of said cylindrical shell;

said electric air heater means being adapted for supplying the heated air at a temperature sufficient to heat said vaporization chamber to a temperature above the vaporization temperature of the liquid being vaporized; and said heat transfer helical fin being adapted for circulating the heated air supplied thereto by said electric air heater means around the outer surface of said vaporization chamber so as to provide for a maximum heat transfer rate to said vaporization chamber, and then passing the heated air through said cavity to the air exhaust pipe of said cylindrical housing so as to allow for the discharge of the heated air from said nontoxic smoke generator by the air exhaust pipe of said cylindrical housing.

8. The nontoxic smoke generator according to claim 7, wherein said nozzle is a wide spray atomizing nozzle.

9. The nontoxic smoke generator of claim 7, further characterized by a layer of insulation between the outer wall and the inner wall of said cylindrical housing.

10. The nontoxic smoke generator of claim 7, further characterized by a support bracket attached to said second end plate, said support bracket having an aperture passing therethrough in alignment with the third aperture of said second end plate, the aperture of said support bracket having said nozzle mounted therein so as to support said nozzle.

11. The nontoxic smoke generator of claim 7, further characterized as having propylene glycol stored within said source of vaporizable smoke producing substance.

12. The nontoxic smoke generator of claim 7, further characterized as having polyethylene glycol 200 stored within said source of vaporizable smoke producing substance.

13. The nontoxic smoke generator of claim 7, wherein said electric air heater means comprises:

a first air heater having an inlet port and an outlet port connected to the first inlet port of said cylindrical housing;

a second air heater having an inlet port and an outlet port connected to the second inlet port of said cylindrical housing; and an air compressor having first and second outlet ports, the first of which is connected to the inlet port of said first air heater and the second of which is connected to the inlet port of said second air heater.

* * * * *